US008485409B2

(12) United States Patent
Chen

(10) Patent No.: US 8,485,409 B2
(45) Date of Patent: Jul. 16, 2013

(54) STAPLER

(75) Inventor: Yun-Lung Chen, Taipei Hsien (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 364 days.

(21) Appl. No.: 12/967,921

(22) Filed: Dec. 14, 2010

(65) Prior Publication Data

US 2012/0018486 A1 Jan. 26, 2012

(30) Foreign Application Priority Data

Jul. 23, 2010 (CN) ..... 2010 1 0234756

(51) Int. Cl.
*B25B 23/00* (2006.01)

(52) U.S. Cl.
USPC ..... 227/63; 227/120; 227/134; 227/156; 7/160; 254/28

(58) Field of Classification Search
USPC ..... 227/63, 120, 134, 156; 254/25, 28; 7/118, 7/128, 160
See application file for complete search history.

(56) References Cited

U.S. PATENT DOCUMENTS

| | | | | | |
|---|---|---|---|---|---|
| 2,233,958 | A * | 3/1941 | Obstfeld et al. | ..... | 227/126 |
| 2,675,989 | A * | 4/1954 | Vogel | ..... | 254/28 |
| 2,832,959 | A * | 5/1958 | Pankonin | ..... | 227/126 |
| 3,056,584 | A * | 10/1962 | Pankonin | ..... | 254/28 |
| 3,549,075 | A * | 12/1970 | Tsunemi | ..... | 227/63 |
| 3,563,513 | A * | 2/1971 | Rubin et al. | ..... | 254/28 |
| 4,727,610 | A * | 3/1988 | Lin | ..... | 7/160 |
| 5,690,268 | A * | 11/1997 | Evans et al. | ..... | 227/156 |
| 5,979,734 | A * | 11/1999 | Chang | ..... | 227/76 |
| 6,062,456 | A * | 5/2000 | Patti et al. | ..... | 227/63 |
| 6,286,745 | B1 * | 9/2001 | Ackeret | ..... | 227/76 |
| 6,371,349 | B2 * | 4/2002 | Laurie | ..... | 227/63 |
| 6,460,433 | B1 * | 10/2002 | Ackeret et al. | ..... | 81/440 |
| 6,481,691 | B1 * | 11/2002 | Irving | ..... | 254/28 |
| 6,708,360 | B2 * | 3/2004 | Ackeret | ..... | 7/160 |
| 6,779,425 | B2 * | 8/2004 | Ackeret et al. | ..... | 81/440 |
| 7,290,694 | B2 * | 11/2007 | Kirby et al. | ..... | 227/156 |
| 2001/0017310 | A1 * | 8/2001 | Laurie | ..... | 227/63 |
| 2001/0037528 | A1 * | 11/2001 | Ackeret | ..... | 7/160 |
| 2003/0088921 | A1 * | 5/2003 | Ackeret | ..... | 7/160 |
| 2004/0040999 | A1 * | 3/2004 | Ackeret | ..... | 227/63 |

* cited by examiner

*Primary Examiner* — Scott A. Smith
(74) *Attorney, Agent, or Firm* — Altis Law Group, Inc.

(57) ABSTRACT

A stapler includes a base and a stapler remover. The base defines a receiving room. The receiving room receives backup staples. The stapler remover is rotatably mounted on the base. The staple remover includes a tilting portion, which is located out of the base. The tilting portion is configured to be arranged in different positions with respect to the base.

11 Claims, 4 Drawing Sheets

STAPLER

BACKGROUND

1. Technical Field

The present disclosure relates to staplers, and particularly to a stapler having a staple remover mounted thereon.

2. Description of Related Art

Staplers are necessary items for office work. However, conventional staplers exhibit a large number of disadvantages. One disadvantage is that a staple remover stationary mounted on the stapler which limit the staple remover from removing the staples in awkward positions. Another disadvantage is that when staples in the stapler are used up, it is often inconvenient to find other staples for replacement.

Therefore, there is room for improvement within the art.

BRIEF DESCRIPTION OF THE DRAWINGS

Many aspects of the embodiments can be better understood with references to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Figure 1:
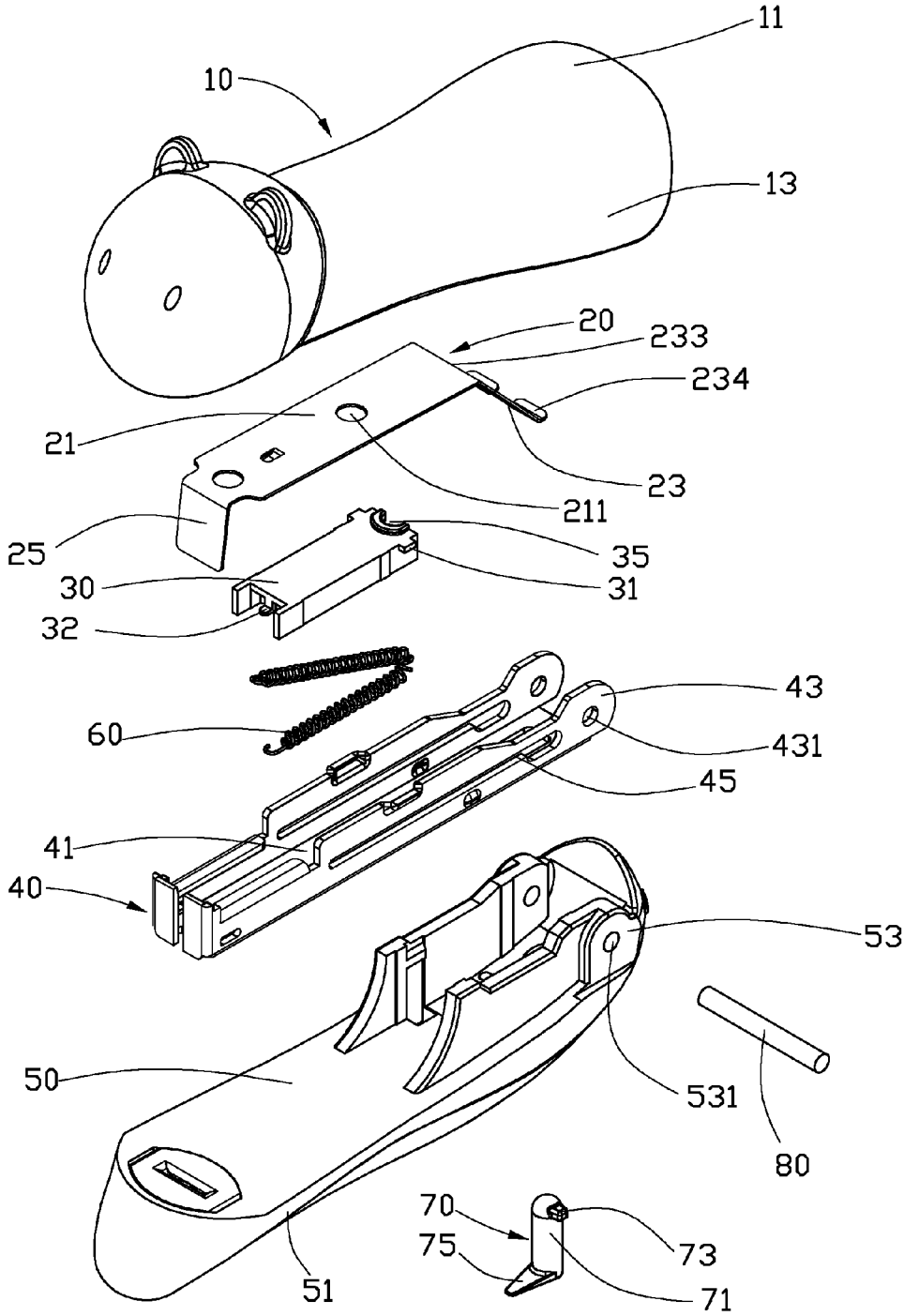
FIG. 1 is an isometric and exploded view of a stapler in accordance with one embodiment.
Figure 2:
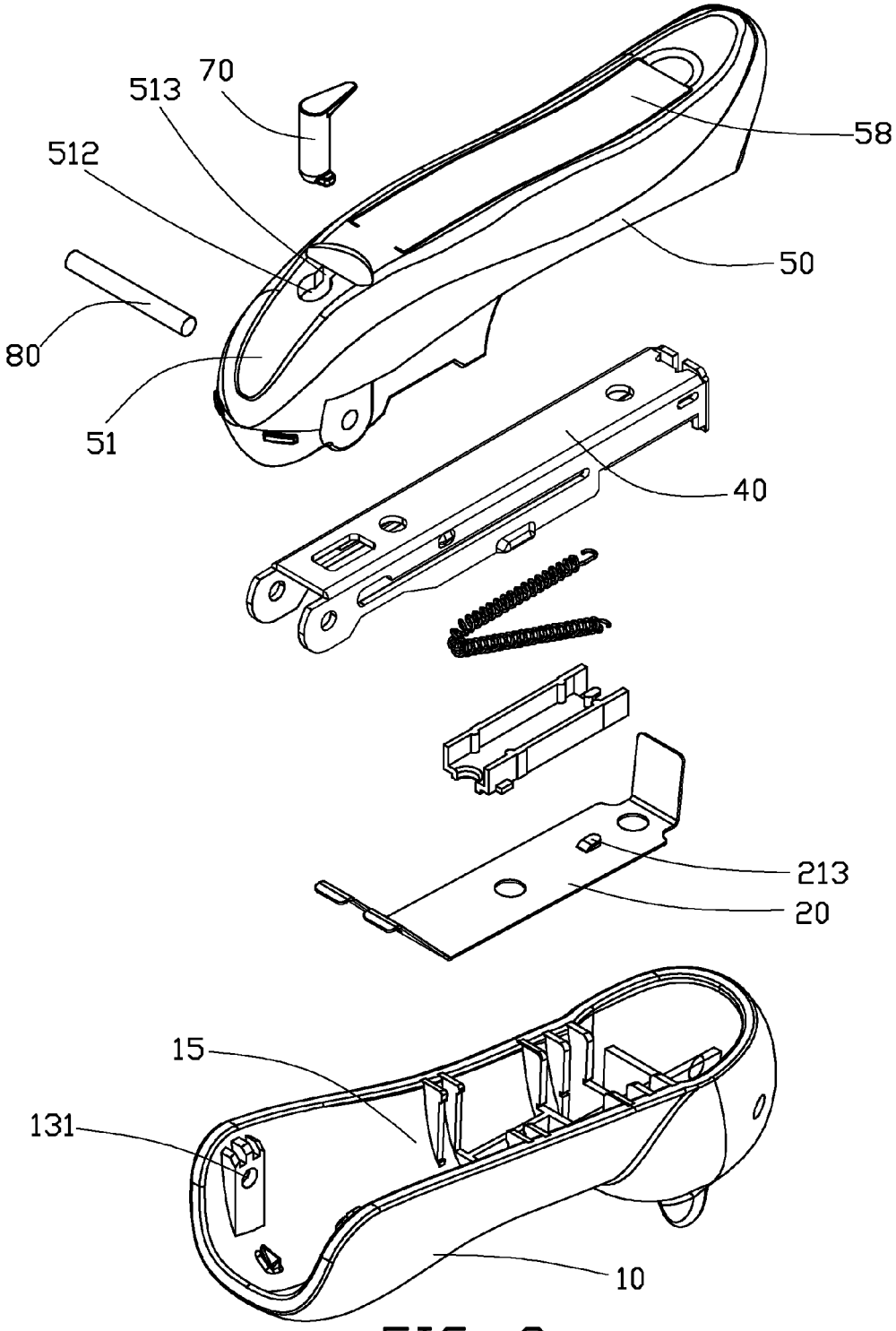
FIG. 2 is similar to FIG. 1, but viewed from another aspect.
Figure 3:
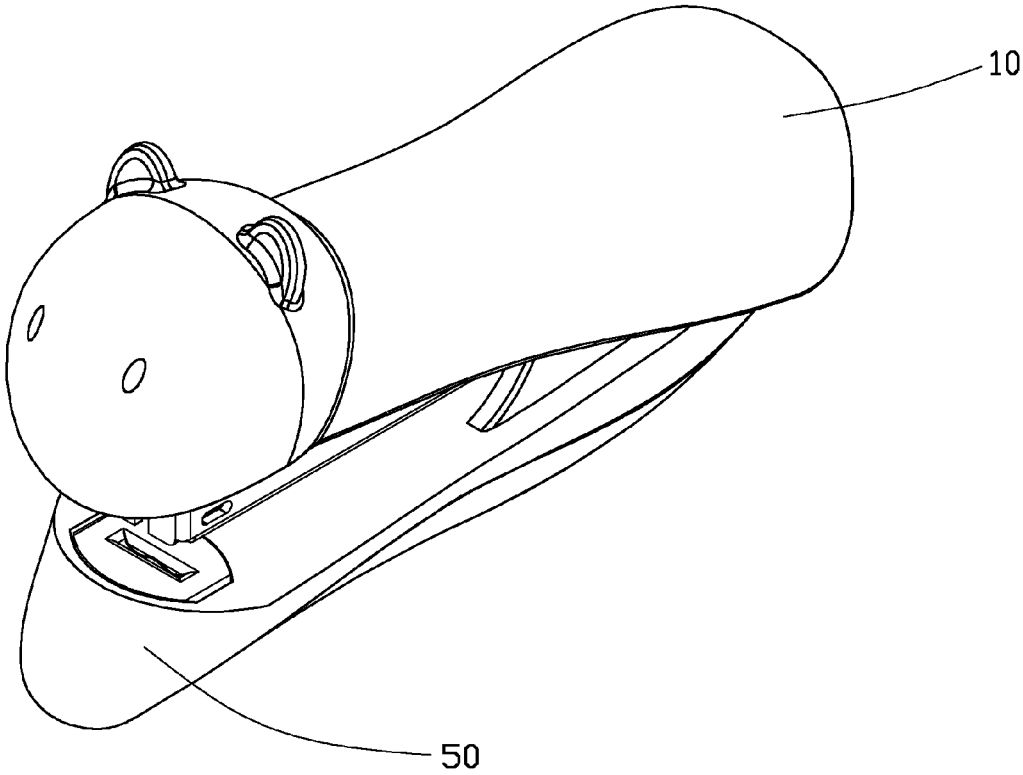
FIG. 3 is an assembled view of the stapler of FIG. 1.
Figure 4:
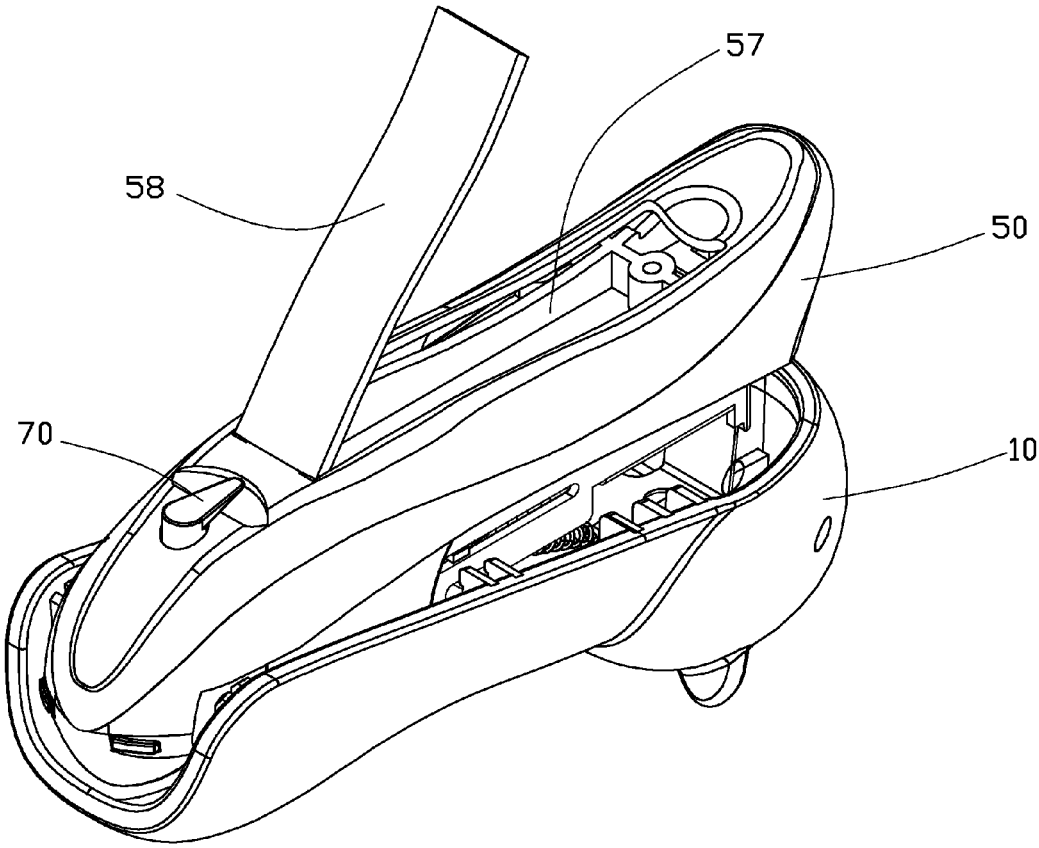
FIG. 4 is another assembled view of the stapler of FIG. 1.

Referring to FIG. 1, referring to FIGS. 1 and 2, a stapler in accordance with an embodiment includes a handle unit 10, a spring piece 20, a follow block 30, a magazine 40, a base 50, a follow spring 60, and a staple remover 70.

The handle unit 10 includes a top plate 11 and a pair of side plates 13. The pair of side plates 13 connects to opposite edges of the top plate 11. A receiving space 15 is defined among the top plate 11 and the pair of side plates 13. A securing pole (not shown) is located in the receiving space 15. A pair of first pivot holes 131 is defined in the pair of side plates 13.

The spring piece 20 includes an inclined stand piece 23, an appropriate upright pressing piece 25, and an appropriate horizontal bridge piece 21. The bridge piece 21 is connected between the stand piece 23 and the pressing piece 25. The bridge piece 21 defines a mounting hole 211 corresponding to the securing pole of the handle unit 10. A first clasp 213 is located on the bridge piece 21. The stand piece 23 includes two separated leg portions 233. Each leg portion 233 includes a foot portion 234, which connects to a distal end of the leg portion 233.

The follow block 30 is generally a rectangular block. A pair of guide tabs 31 is located on the follow block 30. A rear portion of the follow block 30 defines an arc receiving groove 35 therein. The receiving groove 35 extends in an appropriate upright direction. A second clasp 32 is located on a front portion of the follow block 30.

The magazine 40 receives staples therein. The magazine 40 includes a bottom wall 41 and a pair of side walls 43. The pair of side walls 43 connects to opposite edges of the bottom wall 41. Each side wall 43 defines a second pivot hole 431 and a sliding groove 45. The sliding groove 45 extends in a first direction which is perpendicular to the side wall 43.

The base 50 includes a bottom portion 51. A pair of flanges 53 is formed on a rear portion of the base 50. Each flange 53 defines a third pivot hole 531 therein. A receiving hole 512 and a cutout 513 are defined in the bottom portion 51. The receiving hole 512 is coupled with the cutout 513. A receiving room 57 is defined in bottom portion 51. A cover 58 is pivotally mounted on the bottom portion 51, and covers the receiving room 57.

The staple remover 70 includes a rotating post 71. A restricting tab 73 connects to a top portion of the rotating post 71. The restricting tab 73 is perpendicular to the rotating post 71. A tilting portion 75 connects to a lower portion of the rotating post 71. The titling portion 75 has a cone shape.

Referring to FIGS. 1 to 4, in assembly of the stapler, the rotating post 71 of the staple remover 70 is in alignment with the receiving hole 512 of the base 50, and the restricting tab 73 is in alignment with the cutout 513 of the base 50. The rotating post 71 is inserted in the receiving hole 512 with the restricting tab 73 extending through the cutout 513. Then, the rotating post 71 rotates in the receiving hole 512 to misalign the restricting tab 73 with the cutout 513 to rotatably mount the staple remover 70 in the receiving hole 512.

The securing pole of the handle unit 10 is secured in the mounting hole 211 to mount the spring piece 20 in the receiving space 15 of the handle unit 10. The follow block 30 is placed on the bottom wall 41 and located between the pair of side walls 43 of the magazine 40. The guide tabs 31 of the follow block 30 are received in the sliding grooves 45 of the pair of side walls 43. A first end of the follow spring 60 is secured on the first clasp 213 of the spring piece 20. A second end of the follow spring 60 is secured on the second clasp 32 of the follow block 30. A middle portion of the follow spring 60 is located in the receiving groove 35 of the follow block 30. Therefore, the follow spring 60 is bent by the follow block 30.

The foot portions 234 of the spring piece 20 is located on top edges of the pair of the side walls 43. The first pivot holes 131 of the handle unit 10, the second pivot holes 431 of the magazine 40, and the third pivot holes 531 of the base 50 are aligned in a line. A pin 80 is mounted in the first pivot holes 131, the second pivot holes 431, and the third pivot holes 531. Therefore, the stapler is assembled. In this state, the bottom wall 41 of the magazine 40 abuts the staple remover 70.

In the stapler, the staple remover 70 can rotate in the receiving hole 512 to remove staples in different positions. In addition, the receiving room 57 can receive backup staples therein. When staples in the magazine 40 are used up, the backup staples can be removed from the receiving room 57 for use.

It is to be understood, however, that even though numerous characteristics and advantages of the embodiments have been set forth in the foregoing description, together with details of the structure and function of the embodiments, the disclosure is illustrative only, and changes may be made in detail, especially in matters of shape, size, and arrangement of parts within the principles of the present disclosure to the full extent indicated by the broad general meaning of the terms in which the appended claims are expressed.

What is claimed is:

1. A stapler, comprising:

a base defining a receiving room, the receiving room configured to receive staples therein; and a staple remover rotatably mounted on the base, the staple remover comprising a tilting portion which is located out of the base, the tilting portion configured to be located in different positions with respect to the base;

wherein the base defines a receiving hole, the staple remover comprises a rotating post, the tilting portion is connected to the rotating post, and the rotating post is rotatably received in the receiving hole, the staple remover comprises a restricting tab which is connected to the rotating post; the base defines a cutout which is coupled to the receiving hole, the restricting tab is configured to be inserted in the cutout, and is configured to misalign with the cutout to rotatably mount the staple remover in the receiving hole.

2. The stapler of claim 1, wherein the restricting tab is substantially perpendicular to the rotating post.

3. The stapler of claim 1, wherein the stapler comprises a magazine which is pivotally mounted on the base, the magazine comprises a bottom wall, and the bottom wall abuts the staple remover.

4. The stapler of claim 1, wherein the tilting portion has a cone shape.

5. The stapler of claim 1, wherein a cover is pivotally mounted on the base, and the cover is configured to shield the receiving room.

6. A stapler, comprising:

a magazine configured to mount a plurality of staples therein;

a handle unit pivotally mounted on the magazine, the handle unit configured to eject the plurality of staples out of the magazine; and a base pivotally mounted on the magazine, a staple remover rotatably mounted on the base, the staple remover comprising a tilting portion located out of the base, and the tilting portion is configured to be located in different positions with respect to the base;

wherein the base defines a receiving hole; the staple remover comprises a rotating post, the tilting portion is connected to the rotating post, and the rotating post is rotatably received in the receiving hole; the staple remover comprises a restricting tab which is connected to the rotating post; the base defines a cutout coupled to the receiving hole, the restricting tab is configured to be inserted in the cutout, and is configured to misalign with the cutout to rotatably mount the staple remover in the receiving hole.

7. The stapler of claim 6, wherein the base defines a receiving room, and the receiving room configured to receive staples therein.

8. The stapler of claim 7, wherein a cover is pivotally mounted on the base, and the cover is configured to shield the receiving room.

9. The stapler of claim 6, wherein the restricting tab is substantially perpendicular to the rotating post.

10. The stapler of claim 6, wherein the magazine comprises a bottom wall, and the bottom wall abuts the staple remover.

11. The stapler of claim 6, wherein the tilting portion has a cone shape.

* * * * *